US008171991B2

(12) United States Patent
Boyd

(10) Patent No.: US 8,171,991 B2
(45) Date of Patent: May 8, 2012

(54) DRILLSTRING SWIVEL TORQUE MONITOR

(76) Inventor: Anthony Ray Boyd, New Iberia, LA (US)

( * ) Notice: Subject to any disclaimer, the term of this patent is extended or adjusted under 35 U.S.C. 154(b) by 237 days.

(21) Appl. No.: 12/510,411

(22) Filed: Jul. 28, 2009

(65) Prior Publication Data

US 2010/0032208 A1 Feb. 11, 2010

Related U.S. Application Data

(60) Provisional application No. 61/086,835, filed on Aug. 7, 2008.

(51) Int. Cl.
*E21B 47/00* (2006.01)
*E21B 19/00* (2006.01)

(52) U.S. Cl. ..... 166/250.01; 166/85.1

(58) Field of Classification Search ..... 166/378, 166/380, 77.51, 85.1, 250.01; 82/118, 124–127; 81/19, 57.2, 57.24, 57.35
See application file for complete search history.

(56) References Cited

U.S. PATENT DOCUMENTS

| | | | | |
|---|---|---|---|---|
| 4,643,259 | A * | 2/1987 | Zeringue, Jr. | 166/77.51 |
| 4,843,945 | A * | 7/1989 | Dinsdale | 81/57.34 |
| 5,996,712 | A | 12/1999 | Boyd | |
| 6,223,629 | B1 * | 5/2001 | Bangert | 81/57.15 |
| 6,244,345 | B1 | 6/2001 | Helms | |
| 6,553,825 | B1 | 4/2003 | Boyd | |
| 6,915,865 | B2 | 7/2005 | Boyd | |
| 6,994,628 | B2 | 2/2006 | Boyd | |
| 2004/0144547 | A1 * | 7/2004 | Koithan et al. | 166/380 |

* cited by examiner

*Primary Examiner* — Daniel P Stephenson
*Assistant Examiner* — Catherine Loikith
(74) *Attorney, Agent, or Firm* — Law Office of Jesse D. Lambert, LLC

(57) ABSTRACT

Apparatus for rotationally locking the swivel of a drillstring during downhole backoff, directional drilling, and similar operations, and for continuous monitoring of the torque level in the drillstring. A first member has a collar which attaches to one side of the swivel, the collar having a main plate attached thereto and extending outwardly from the swivel. A second member is suspended from the plate, and has a set of jaws which can be closed to grip the swivel and thereby rotationally lock the swivel. A means for measuring forces between the first and second members is disposed between the first and second members, and in combination with appropriate processing and controls permits monitoring of torque on the drillstring while the drillstring is raised and lowered as desired.

10 Claims, 12 Drawing Sheets

DRILLSTRING SWIVEL TORQUE MONITOR

CROSS REFERENCE TO RELATED APPLICATIONS

This regular patent application claims priority to U.S. Provisional Patent Application Ser. No. 61/086,835, filed Aug. 7, 2008, for all purposes.

BACKGROUND

1. Field of the Invention

This invention relates to apparatus used in connection with the drilling and servicing of boreholes in the earth, more particularly those frequently referred to as "wells," such as oil and gas wells. More particularly, this invention relates to apparatus used in connection with the handling and manipulation of tubular strings, commonly referred to as drillstrings and workstrings.

2. Related Art

The drilling of earthen boreholes, namely "wells" (that term being used broadly, to include oil wells, gas wells, saltwater disposal wells, and any other type of earthen borehole), frequently involves the use of a long tubular string, often called a drillstring, which holds a drill bit at its lower end. The drill bit is rotated, either by rotation of the drillstring from the surface via a rotary table or a top drive; or by a downhole device, such as a so-called "mud motor" or turbine.

Certain operations associated with the drilling function result in the drill string being rotationally fixed, yet it is desirable to monitor the torque being imposed on the drillstring. By way of example, from time to time, the drillstring will become stuck in the well (unable to be pulled out of the wellbore, unable to be rotated, etc.), due to one or more of a variety of downhole conditions (sloughing formations, pressure differential sticking, etc.).

Once the drillstring is stuck, various means known in the relevant art must be employed to remove the drillstring, so that the borehole can be re-drilled as necessary. A common sequence is to determine the approximate depth (below the surface or other datum) at which the drillstring is stuck (which is typically done by means of a "free point" tool), then backoff or unscrew the nearest threaded connection above the stuck point. The free section of drillstring can then be retrieved from the wellbore. Efforts can then commence to retrieve the stuck section remaining in the wellbore, frequently involving "washing over" the stuck pipe, engaging the uppermost end of the stuck pipe with a grapple, then commencing efforts to pull the stuck section out of the borehole.

It can be appreciated that in order to back off or unscrew the appropriate threaded connection, reverse torque must be placed on the connection. This task is complicated by the fact that the connection in question may be located many thousands of feet below the rig floor, by way of example 5,000' to 10,000' deep. Suffice to say that with such depths, there is considerable yielding of the drillstring over such a long length, and imposing torque at the rig floor by rotating the drillstring in a reverse direction (reverse typically being counter-clockwise, when viewed from above) does not instantly result in torque being applied at the desired connection. In effect, the reverse torque is resisted by friction between the drillstring and the casing/borehole, and/or is effectively absorbed by the rotational elasticity of the drillstring. In order to "work down" torque to the desired connection, the appropriate torque (in terms of number of turns of the drillstring) must be imposed at the surface, then the drillstring is raised and lowered at the surface while the reverse torque is held in place on the drillstring at the surface. The raising and lowering of the drillstring at the surface is due at least in part to stretching of the drillstring. By this means, the reverse torque is gradually worked down to the connection in question. Once the reverse torque is imposed on the desired connection, means known in the art field in question (frequently, an explosive charge lowered on an electric line, called a "string shot") are employed to impart a localized percussion force at or near the connection, with the goal being that the desired connection (rather than one at a shallower depth) is "backed off" or unscrewed.

It can be seen from the foregoing description that a fundamental part of the backing-off procedure is the imposition of torque (particularly, reverse torque) on the drillstring at the surface (that is, in the working area above the rig floor), and holding the reverse torque on the drillstring while the drillstring is raised and lowered. A device known as a "drillstring swivel," referred to herein by that term or simply as "swivel," permits rotating the drillstring below the swivel, while permitting structural elements above the swivel to remain stationary.

A key problem, then, that the present invention addresses is the imposition of torque on the drillstring while raising and lowering the drillstring, in a safe manner. A further problem is that of monitoring the value of the torque on the drillstring during this operation.

One prior art manner of holding torque on the drillstring while raising and lowering same was to use a set of conventional drillpipe tongs hold torque, after the rotary or other means had been used to rotate the drillstring in reverse. A load cell could be placed in the tong holdback line, in order to monitor the force (and consequently torque) being imposed on the drillstring. While the drillstring could then be raised and lowered within the bounds of the length of the tong cable, it can be appreciated that this method carries a number of disadvantages, including:

- Limited distance that the drillstring can be raised—constrained by the length of the holdback line on the tongs
- Risk of injury to personnel, as this method creates a situation in which mechanical members with very high forces imposed on them are being moved about above the rig floor at heights which could result in serious injury or death if failure occurred. In particular, a line and tong with very high forces thereon are being moved up and down above the rig floor. Should the tong line break, the line could swing around, and/or the tong itself swing around, and strike someone with great force. Similar events could occur should the tongs lose their "bite" on the pipe, or slip, in which case the tong body could swing around with great force.

Other disadvantages exist to this old method, but the safety aspect is one of the most important.

Other tools were developed in an effort to address the tong and cable issue noted above, said tools are generally referred to as "locking swivels." Examples of such apparatus known to applicant include those disclosed in U.S. Pat. Nos. 5,996,712 and 6,244,345. These prior art tools comprise internal mechanisms to lock together the two halves of the swivel, making it non-swiveling, or when desired to unlock the swivel and permit the two halves to rotate with respect to one another. These locking swivels permit the top drive unit, rather than the tong/cable, to hold or maintain the desired reverse torque, thereby resolving at least some of the safety issues associated with the tong/cable procedure described above. However, a disadvantage with known locking swivels is that when locked, and consequently some level of torque held in place on the drillstring, the amount of torque on the drillstring cannot be measured or monitored.

There are other operational situations in which it is desired to hold the drillstring against rotation at the surface, while monitoring the torque thereon; an example is directional drilling using downhole motors, where the reactive torque must be held at the surface, while desirably measuring the value of the torque.

The present invention addresses these issues. Namely, the problem of releasably locking the two sides or halves of a swivel to one another, in a rotational sense, by external means, while retaining the ability to monitor torque between the two sides of the swivel, is solved by an apparatus having first and second members, one of said members attached to the exterior of each side of the swivel (that is, one member on one side of the swivel joint, and the other member on the other side of the swivel joint), at least one of said members releasably gripping one side of the swivel, and a means for monitoring and measuring forces between the first and second members, in order to enable torque calculations and the display and monitoring of torque values.

DESCRIPTION OF THE PRESENTLY PREFERRED EMBODIMENT(S)

While those having ordinary skill in the relevant art field will recognize that various embodiments are possible within the scope of the present invention, with reference to the drawings some of the presently preferred embodiments will now be described.

Figure 1:
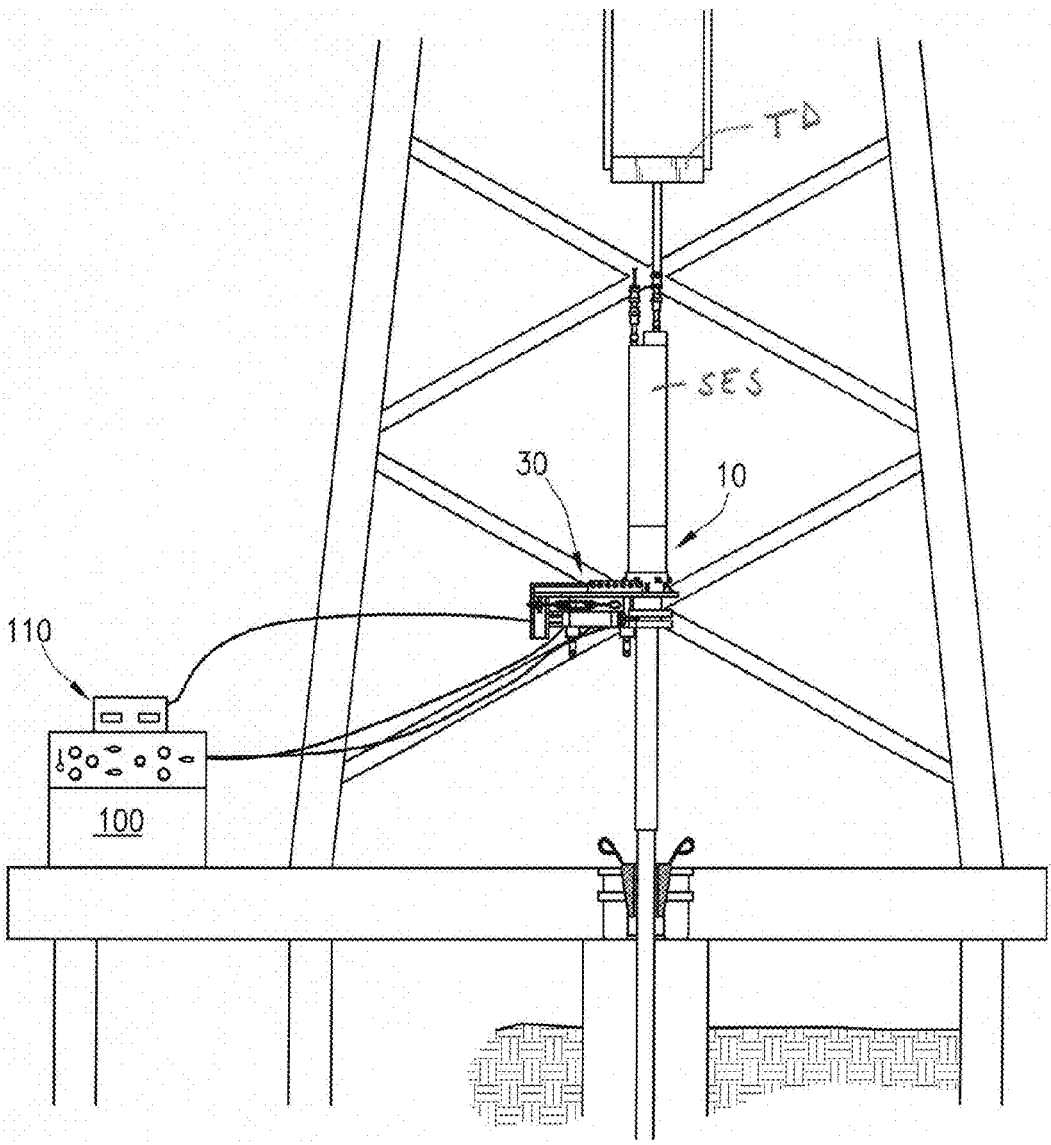
FIG. 1 is a drawing showing the apparatus of the present invention in place in a typical operational setting.

FIG. 1 is an overall view of the apparatus (drillstring swivel torque monitor 30) of the present invention in a typical operational setting, mounted in place on a swivel incorporated near the upper end of a drillstring, with a side entry sub (SES) and top drive unit (TD) mounted above the apparatus. The purpose of the swivel is to permit rotation of the drillstring below the swivel joint (that is, the drillstring down to the drill bit or other downhole assembly), while the drillstring above the swivel joint (typically, up to a top drive unit) remains stationary. As previously described, this relative rotation is necessary in various well servicing operations.

Figure 2:
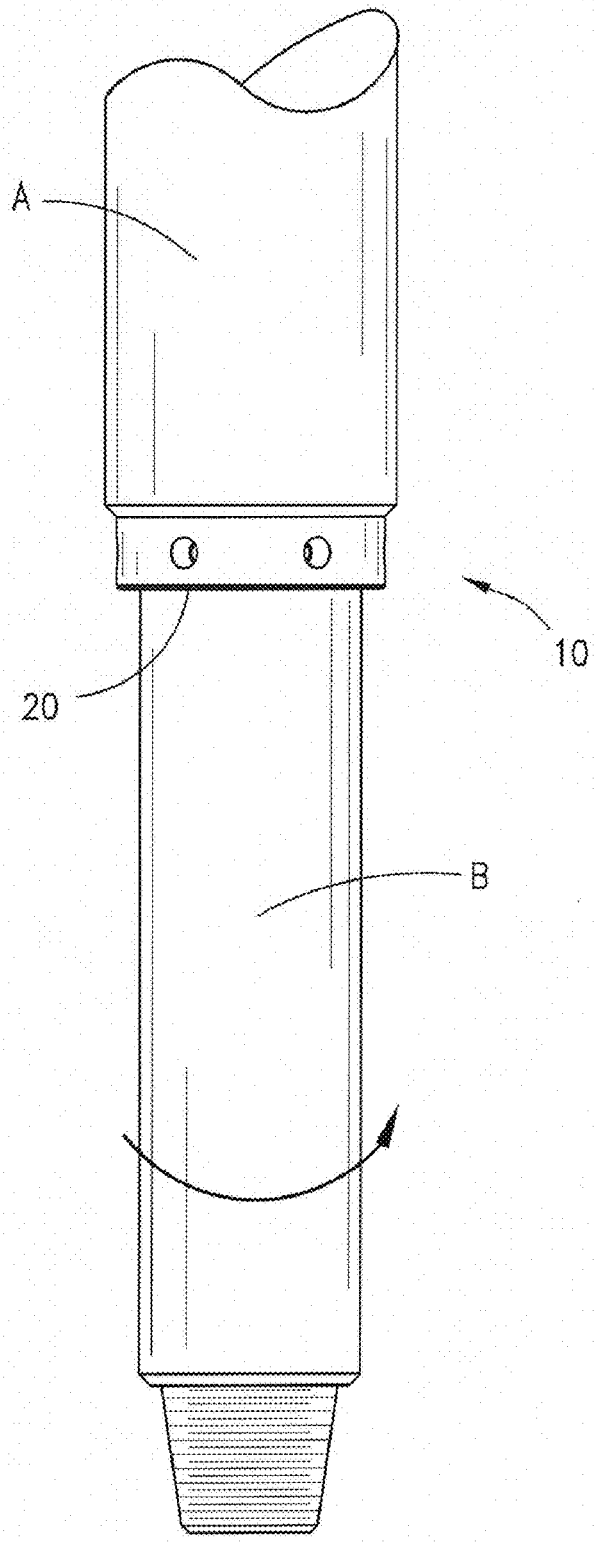
FIG. 2 is a view of a drillstring swivel.

FIG. 2 shows a typical swivel 10, which permits rotational swiveling between the two sides, or upper and lower halves, of the swivel, denoted as A and B. For purposes of this patent application, the point at which the two sides of the swivel meet will be referred to as the swivel joint, denoted as 20. It is to be understood that lower half B can rotate with respect to upper half A, as denoted on the drawing. Typically, upper half A (which is connected directly or indirectly to a top drive unit, for example, as shown in FIG. 1) does not rotate (unless rotated by the top drive unit). It is to be understood that various positional terms in this application are used to describe structure with respect to the usual, substantially vertical position of swivel 10, as illustrated.

Figure 3:
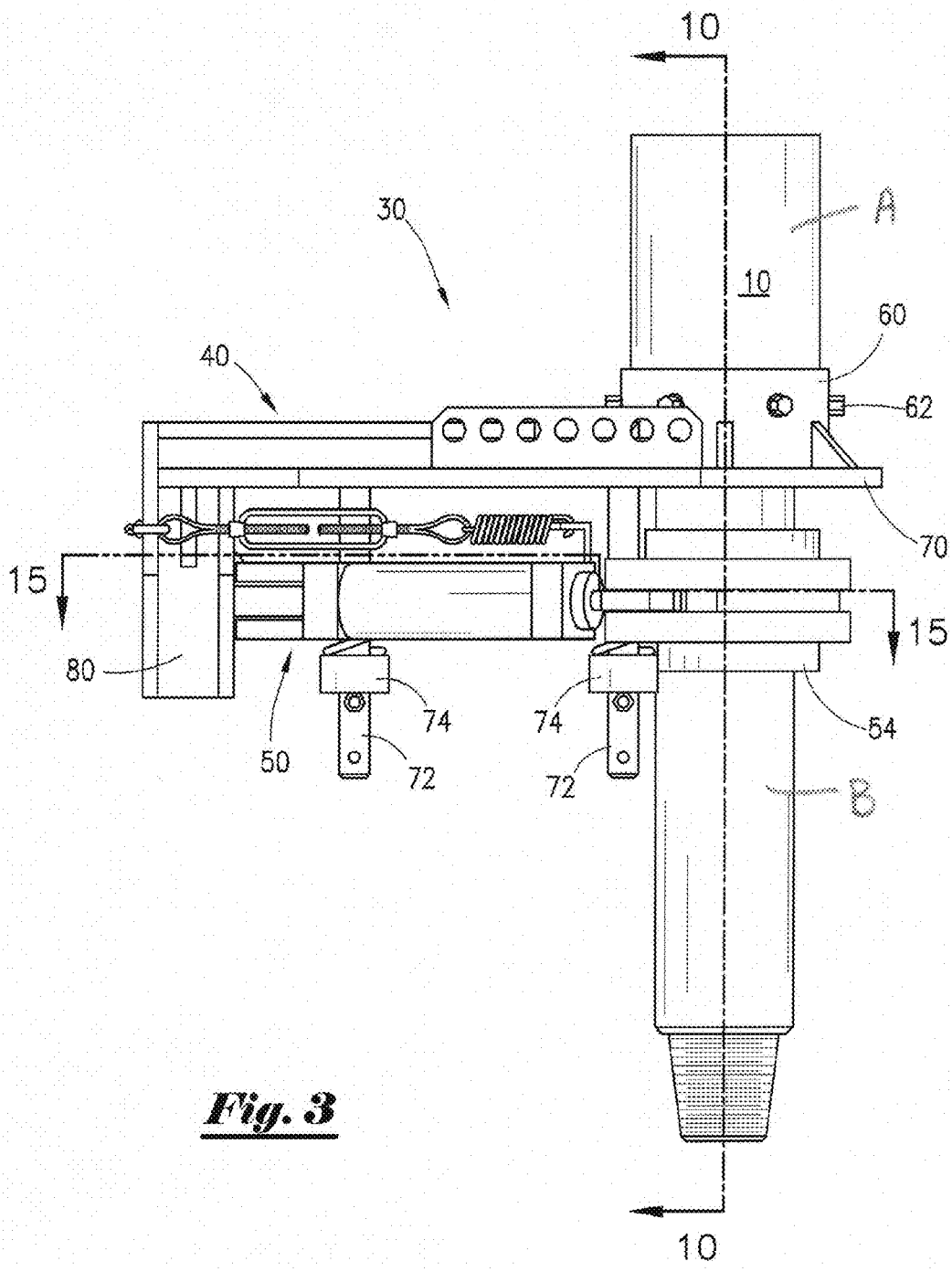
FIG. 3 is a side view of the apparatus of the present invention, mounted on a drillstring swivel.
Figure 4:
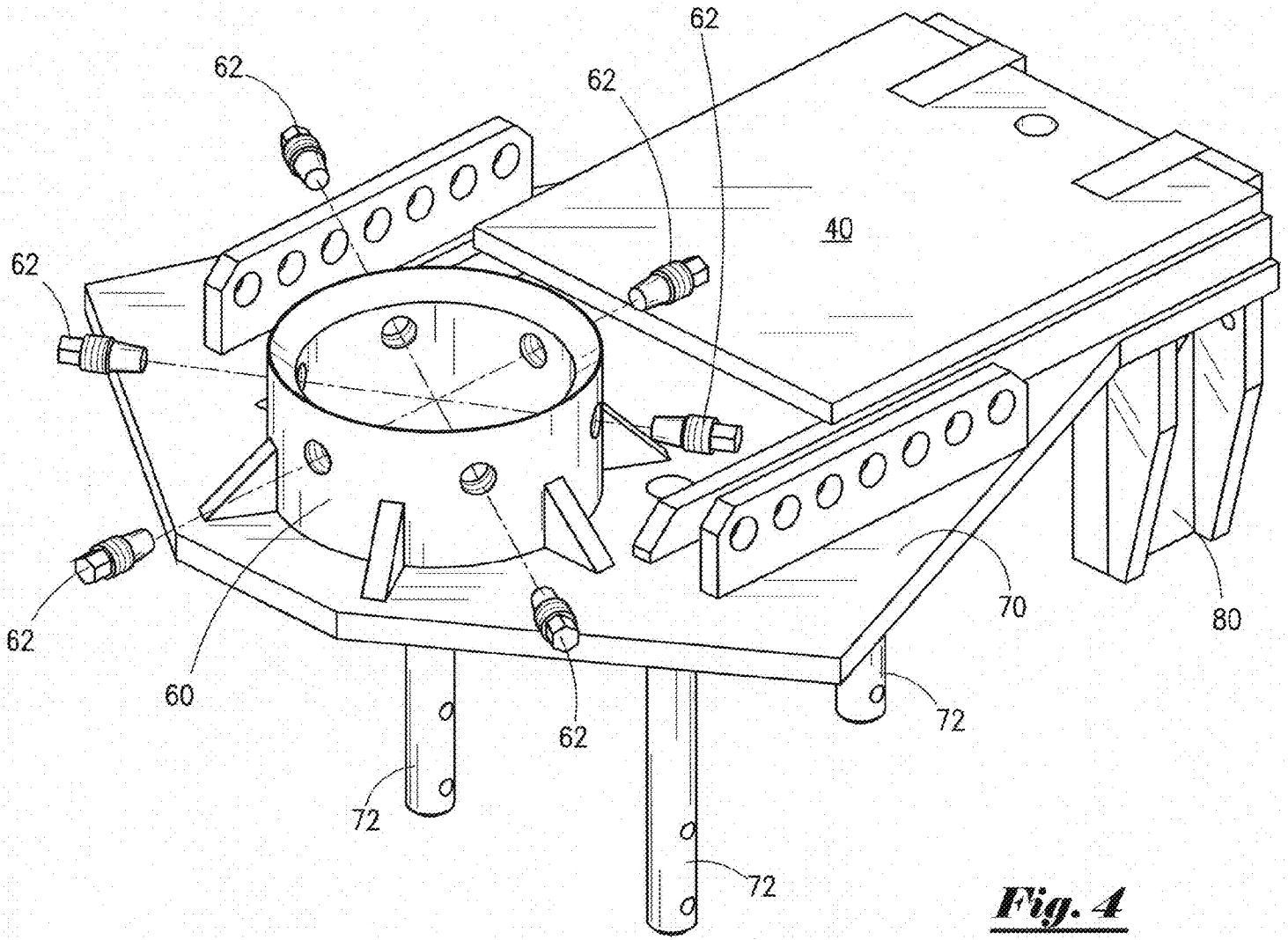
FIG. 4 is a perspective view of the first member of the drillstring swivel torque monitor of the present invention.
Figure 5:
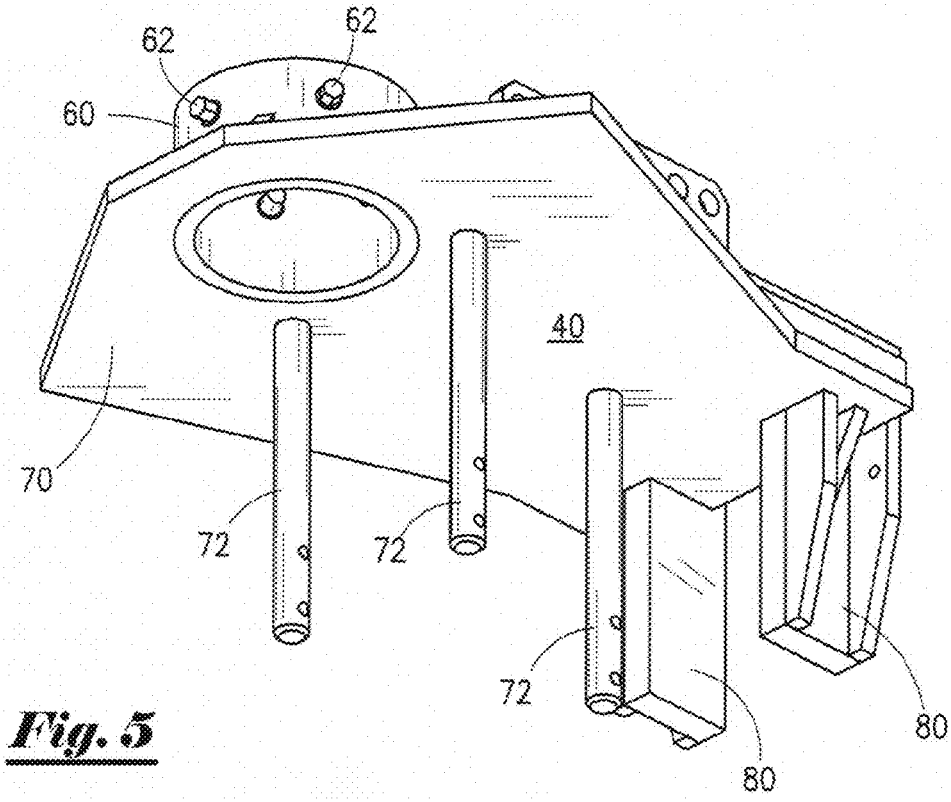
FIGS. 5-8 are additional view of the first member of the present invention.
Figure 6:
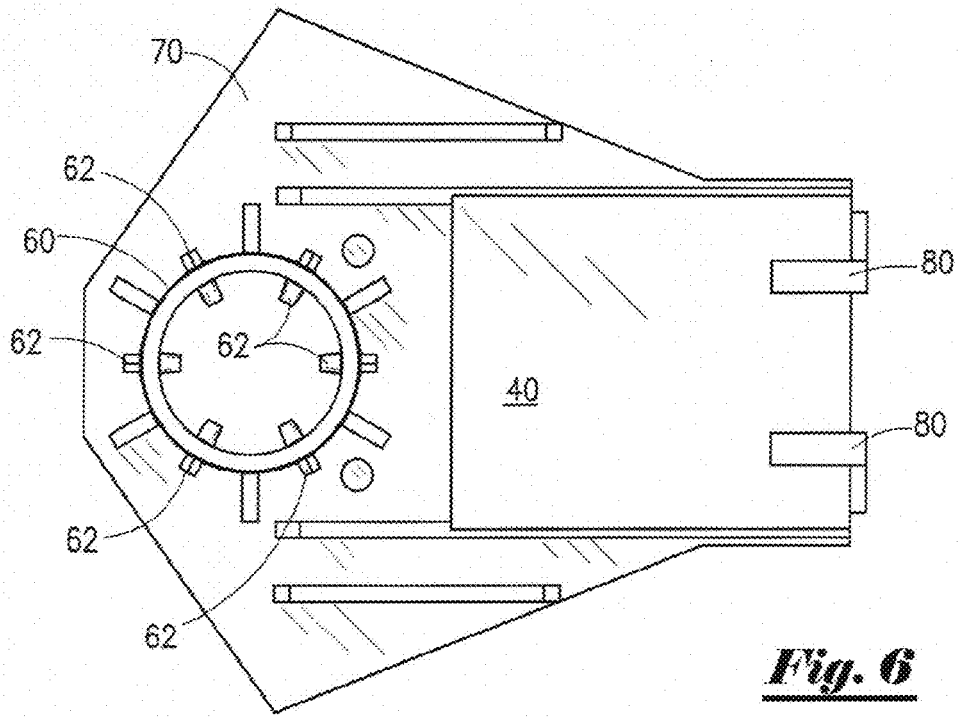
Figure 7:
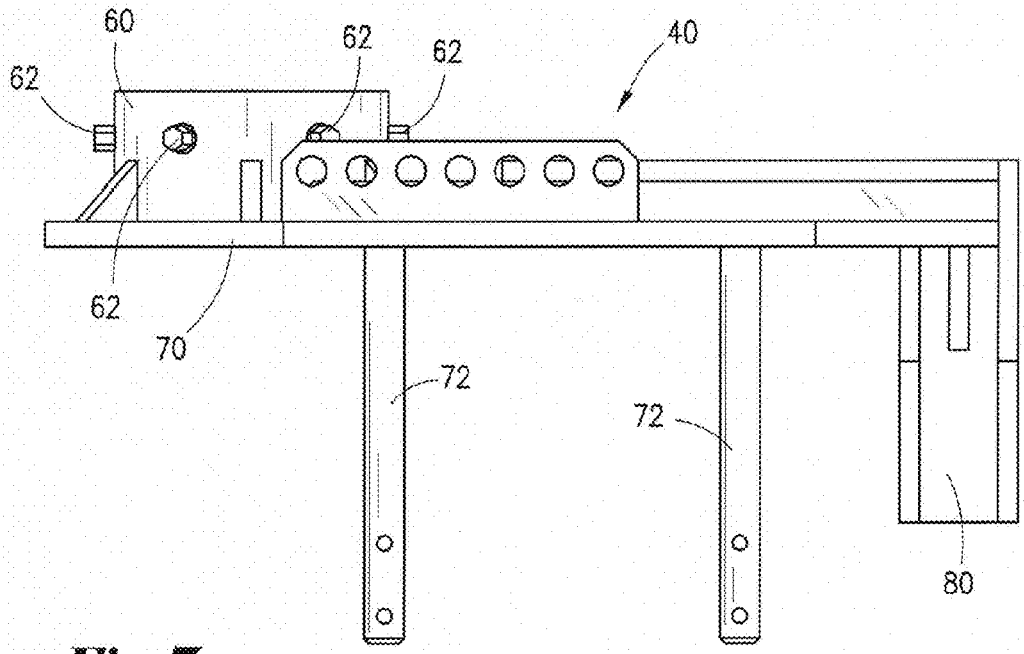
Figure 8:
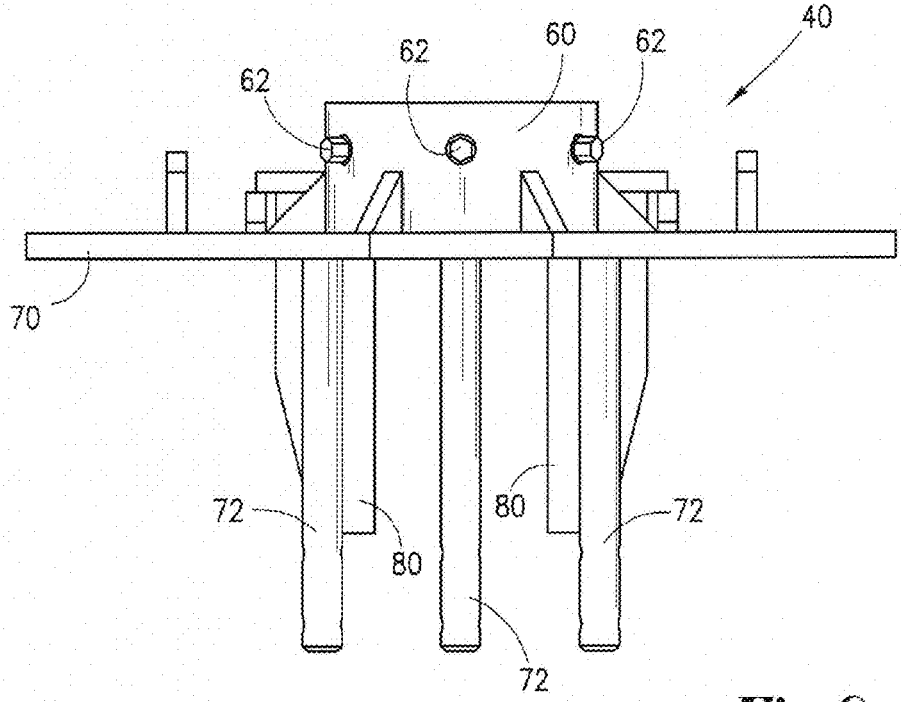
Figure 9:
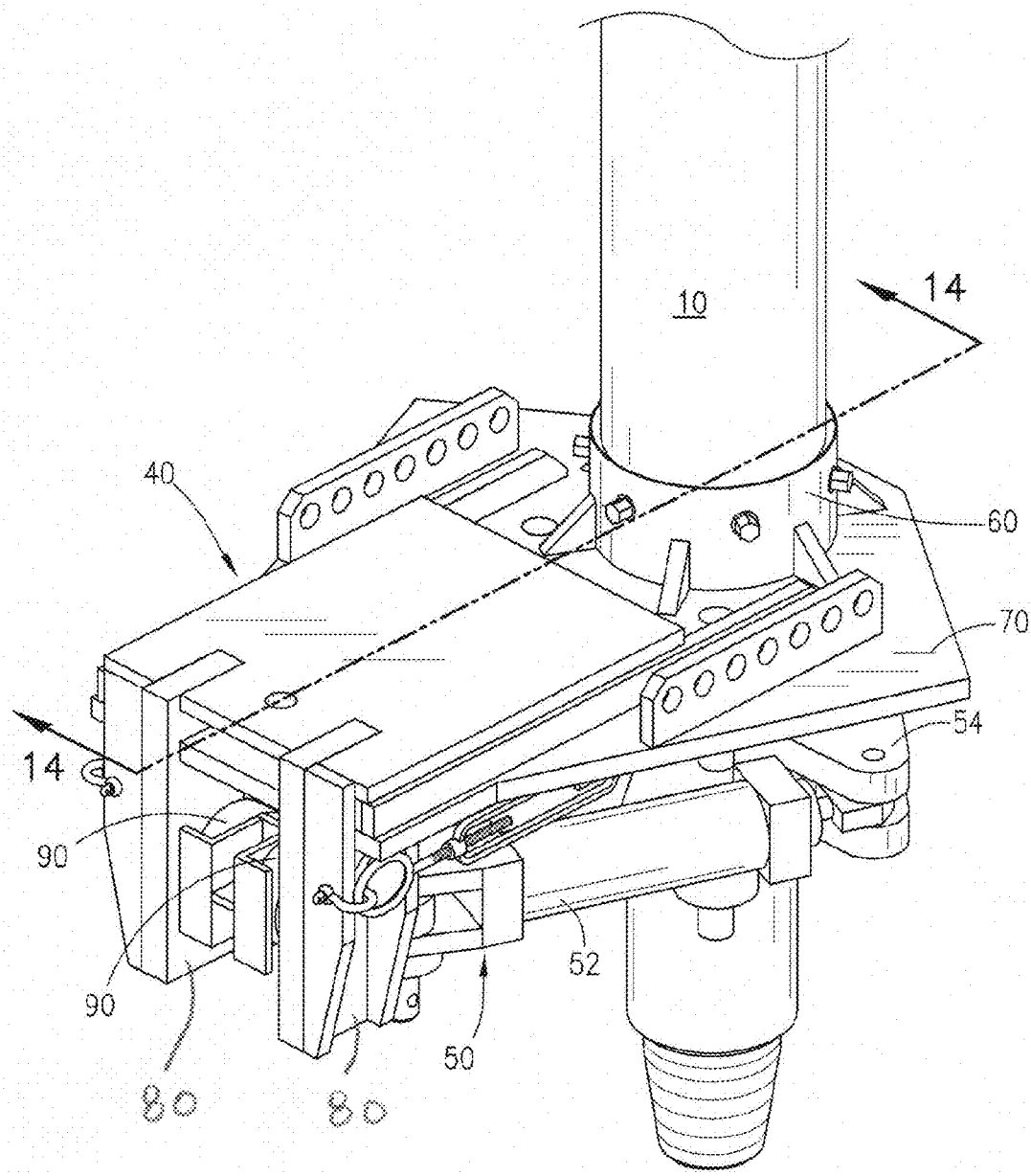
FIG. 9 is a perspective view of the apparatus of the present invention, mounted on a drillstring swivel.

FIG. 3 shows a side view of an embodiment of the present invention, mounted on swivel 10. Broadly, drillstring swivel torque monitor 30 comprises a first member 40 connected to one side of swivel 10 (typically the upper half A), a second member 50 connected to the other side (typically, the lower half B) of swivel 10, and a means for measuring forces between first member 40 and second member 50 (shown in later drawings), resulting from torque being imposed between the two sides of swivel 10. The amount of torque between the two sides of the swivel can then be calculated, and as a result the present invention enables torque between the two sides of the swivel to be held or maintained, measured and monitored. Preferably, one of the first and second members 40 and 50, typically first member 40 which is positioned above second member 50, is attached to a side of the swivel in a manner which not only fixes the member to the swivel side in a rotational sense, but also provides vertical load carrying capability. In addition, preferably the other member releasably connects to the other side of the swivel by a means for releasably gripping the swivel, which enables easy connection and disconnection from that side of the swivel.

FIGS. 4-9 are also helpful in describing the structure of first member 40. First member 40 comprises a collar 60 which encircles one side of swivel 10, preferably, and as shown, the upper side. A main plate 70 is attached to collar 60, and when mounted on a swivel extends outwardly (typically, generally horizontally) from swivel 10. A plurality of threaded fasteners 62 connect collar 60, and consequently main plate 70, to swivel 10. A means for connecting first and second members 40 and 50 is provided, which in the preferred embodiment comprises a pair of spaced apart stop plates 80 on first member 40 which extend downwardly from main plate 70, leaving an opening between stop plates 80, into which second member 50 and a means for measuring force between first and second members 40 is preferably positioned, as is later described.

Figure 10:
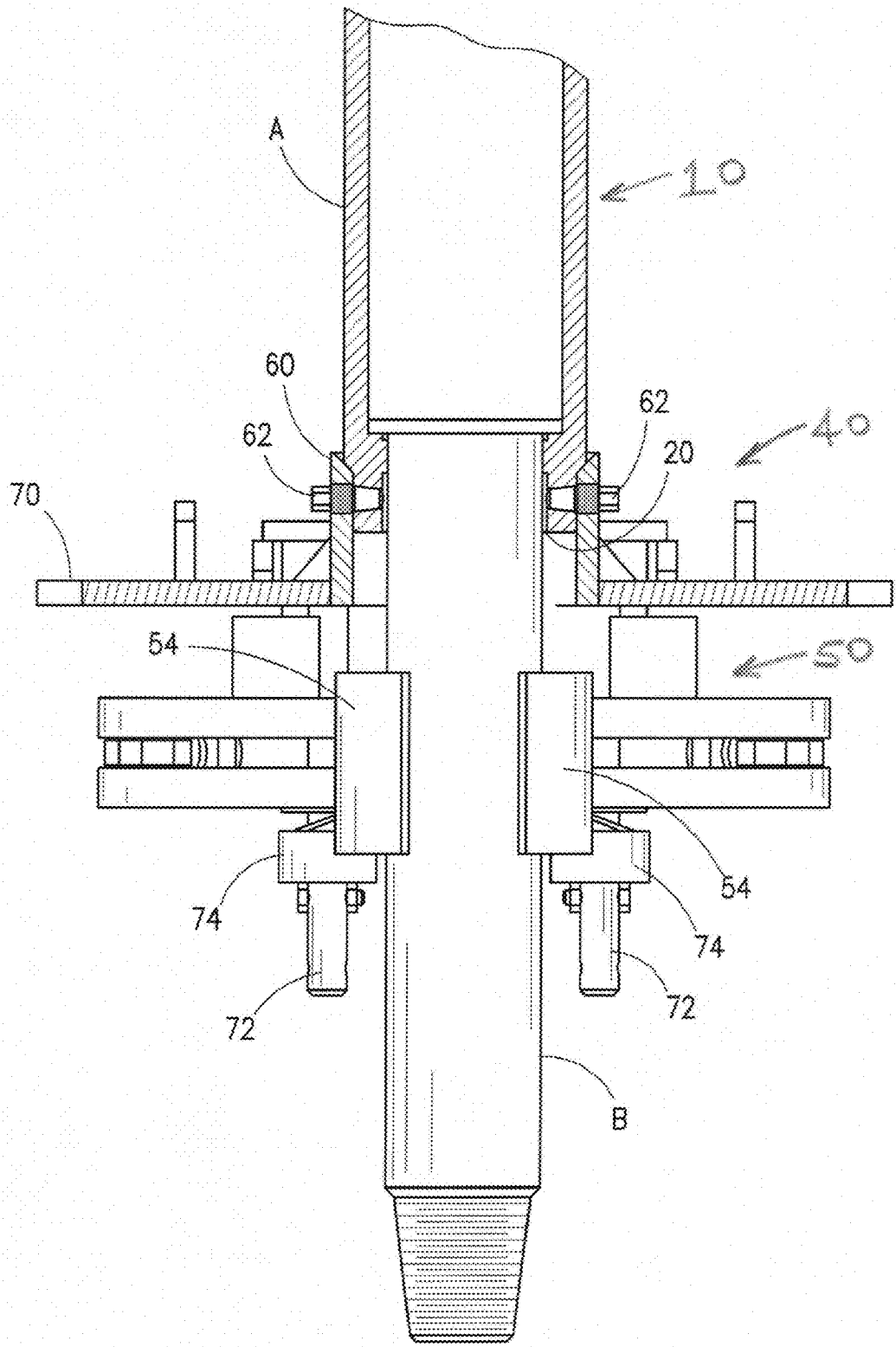
FIG. 10 is a partial section view of the apparatus, along the section line shown in FIG. 3.

Referring to FIGS. 3, 9, 10, 14 and 15 the present invention further comprises second member 50, which in the preferred embodiment comprises a releasable gripping means comprising a plurality of jaws which may be opened to release the lower half of swivel 10, and then closed to rotationally lock the upper and lower halves of the swivel. In the embodiment illustrated, lower member 50 comprises a set of jaws 54 powered by hydraulic cylinders 52, similar in design to so-called "backup" systems in current use in the relevant art field in connection with the makeup and breakout of threaded connections. Second member 50 is suspended on rods 72 which are connected to main plate 70 of first member 40, seen in FIGS. 3-5, 7-10, 14 and 15; effectively, second member 50 hangs from first member 40. Spring loaded seats 74 may be provided as appropriate. As can be seen from the drawings, a portion of second member 50 is disposed within the opening between stop plates 80 in main plate 70. A means for measuring force imposed between first and second members, which in the preferred embodiment is a load cell 90, is disposed between second member 50 and plates 80. It can be readily understood that with first member 40 attached to the upper half of swivel 10, and second member 50 latched onto the lower half of swivel 10, torque between the two halves of swivel 10 attempts to turn second member 50, which imposes a force on load cell 90. This force is monitored and measured as later described, and by appropriate means permits determination of relative torque. FIG. 10 is a side view of the present invention, in place on a swivel, from the direction shown by the reference section lines in FIG. 3.

Figure 11:
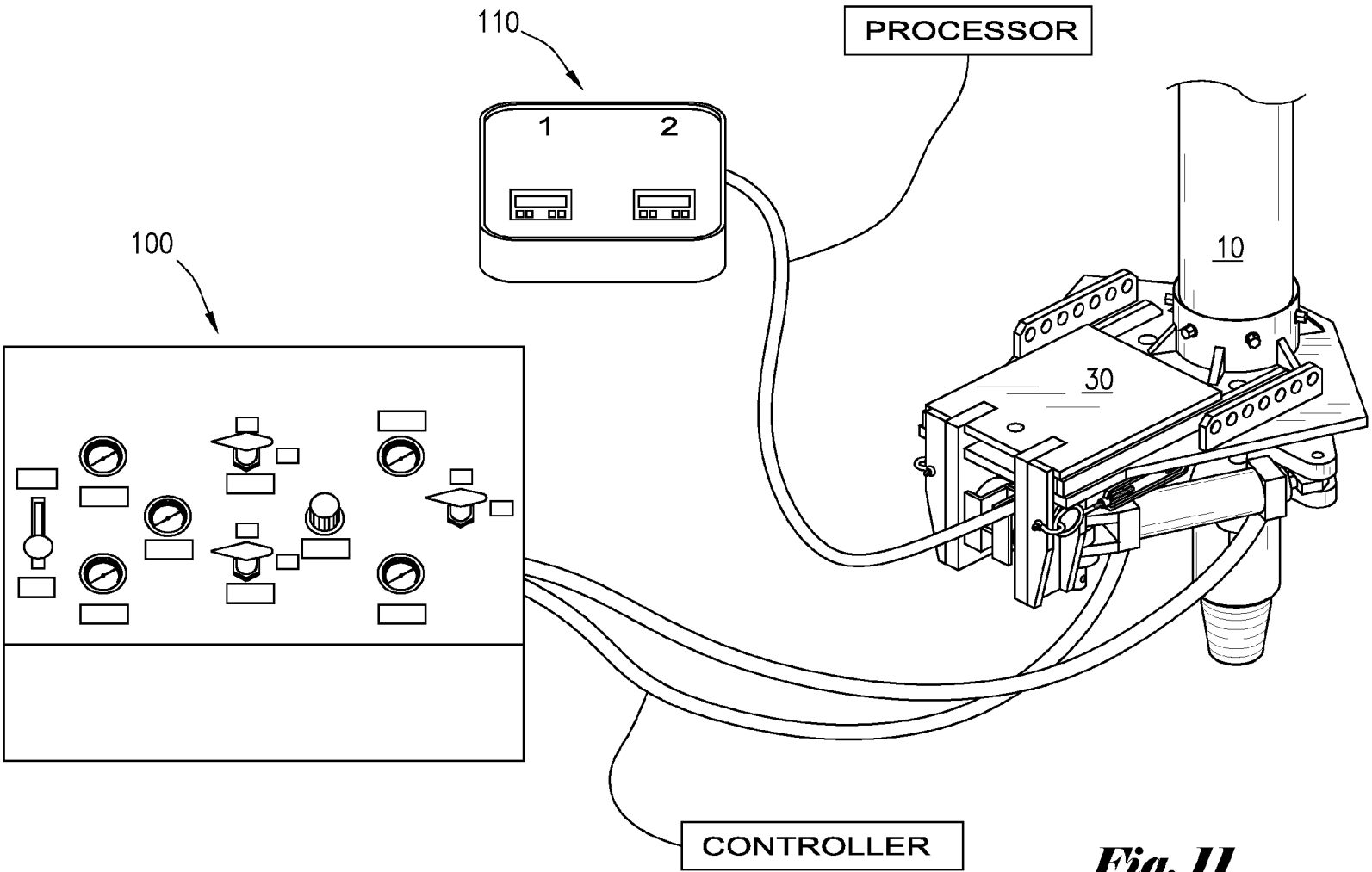
FIG. 11 is a view of the present invention, showing the drillstring swivel torque monitor mounted on a drillstring swivel, with control panel, torque monitoring panel, processor and controller shown.
Figure 12:
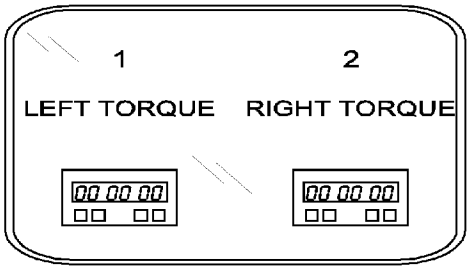
FIGS. 12 and 13 are views of the torque monitoring panel and control panel.
Figure 13:
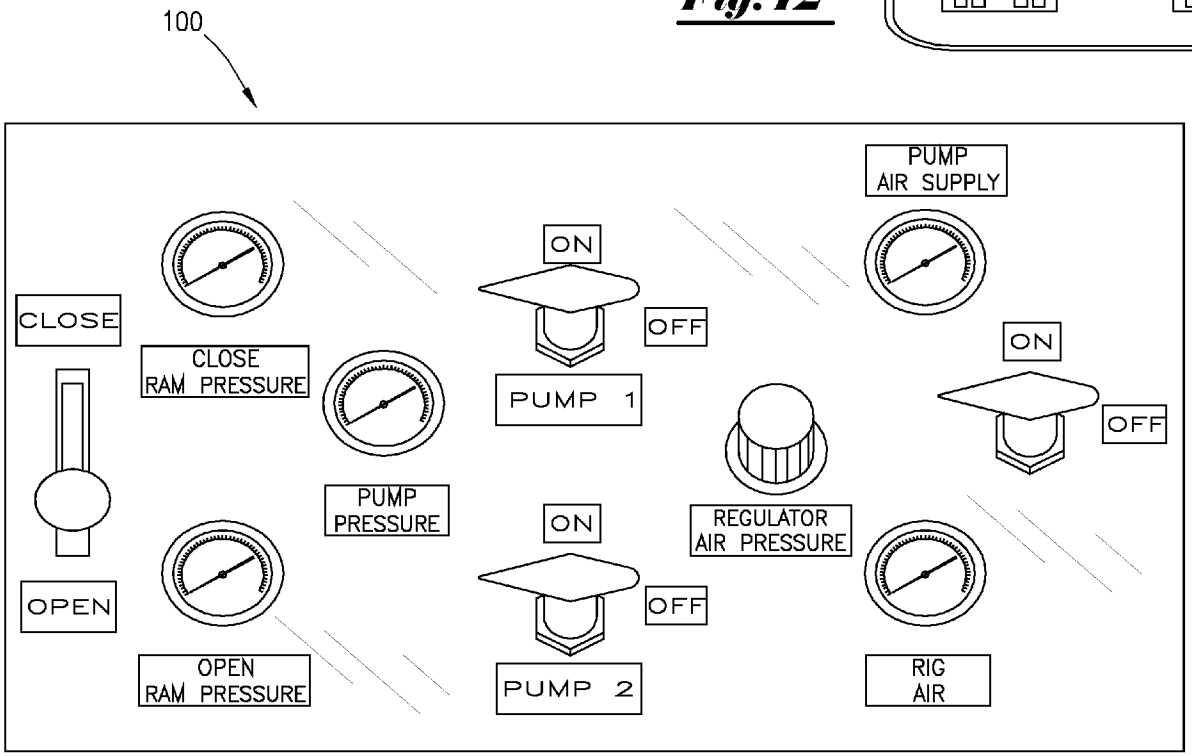
Figure 14:
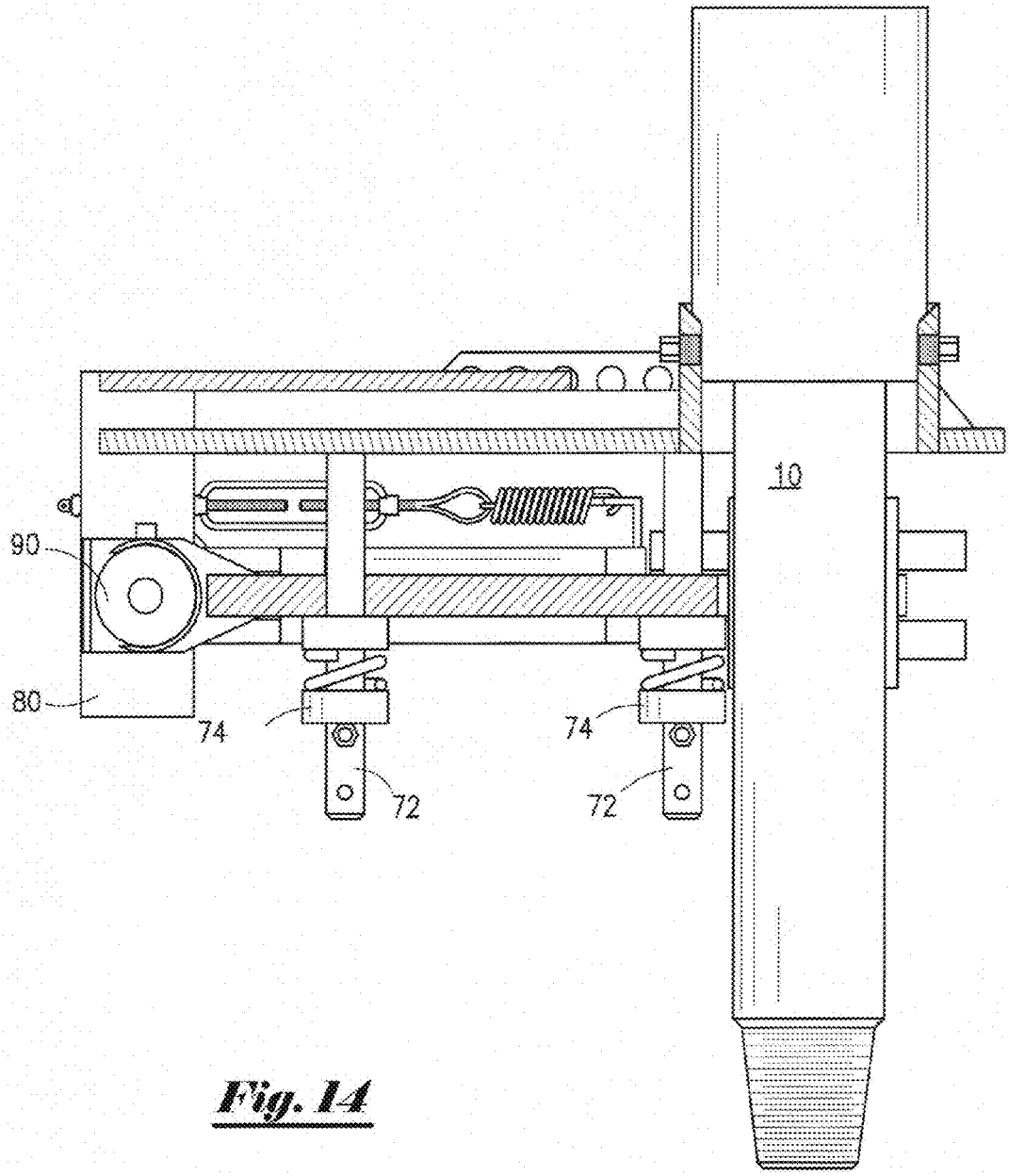
FIG. 14 is a side view in partial section, along the section line shown in FIG. 9.
Figure 15:
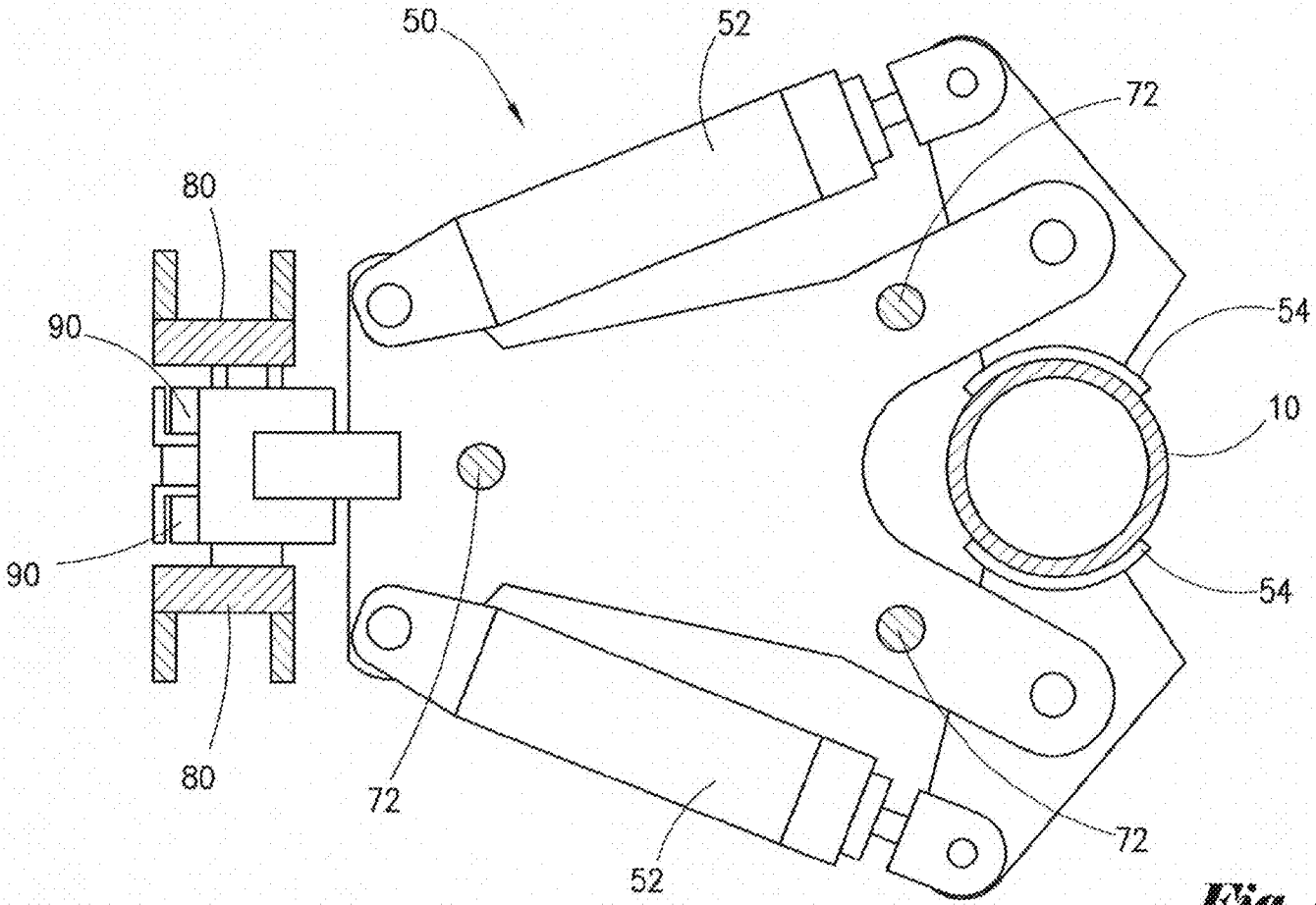
FIG. 15 is a top section view, along the section line shown in FIG. 3.

Appropriate controls and measurement apparatus are provided in order to operate the invention. In addition, a means for determining torque between said first member and said second member is provided, which comprises load cell 90, a processor or microprocessor, and control/monitoring panels is provided. FIGS. 11-13 show exemplary layouts of the control panel and torque monitoring panel. Control panel 100 comprises controls for second member 50, namely to manipulate the hydraulic cylinders 52 to open and close the jaws 54 thereof so as to grip and release the lower half of swivel 10 as desired. Torque monitoring panel 110 displays "left torque" and "right torque," which is relative torque between the two halves of the swivel. Controllers, processors, microprocessors, and computer programming as appropriate and as known to those having ordinary skill in the art are provided in order to operate the apparatus and to provide a means for measuring force imposed between first and second members 40 and 50, and for monitoring torque between said first and second members.

Operation of the Apparatus

An exemplary operation of the present invention will now be described. As previously set out, a typical, although not exclusive, operation is in conjunction with a stuck pipe scenario. In order to accomplish a downhole backoff, reverse or left hand torque must be imparted to a downhole threaded connection, typically by "working down" the torque to the desired point.

A drillstring connection above the drillfloor is backed off, preferably at a convenient height above the rig floor. A swivel 10 (previously described) is connected to the upper end of the drillstring, typically screwed to the drillstring. As shown in FIG. 1, a side entry sub may be connected to the top of the swivel, in order to permit a wireline to be inserted down the drillstring; the upper end of the side entry sub is connected to the top drive or other rig components.

The present apparatus, the drillstring swivel torque monitor 30, is then connected to swivel 10. Typically, the apparatus 30 is attached to swivel 10 before swivel 10 is made up into the drillstring, by inserting swivel 10 through collar 60 and engaging the threaded fasteners 62. Control panel 100 and torque monitoring panel 110, processor and controller are put in place, along with control lines as appropriate to permit opening and closing of the jaws 54 on second member 50. FIG. 1 shows the apparatus in place on the swivel, in a typical setting. A typical sequence follows:

- second member jaws 54 are opened, so as to release second member 50 and permit rotation between the two halves of the swivel 10
- reverse or left hand torque is imposed on the drillstring (below the swivel joint 20), by various means. The drillstring may be rotated by a power tong apparatus; or alternatively, a set of slips may be used to grasp the drillstring by the rotary table of the rig, the rotary table engaged to rotate the drillstring in reverse, and left hand torque imposed in that manner
- once the desired number of left hand turns of the drillstring have been imposed (based on appropriate calculations), jaws 54 of second member 50 are engaged so as to rotationally lock the first and second members 40 and 50, and the upper and lower halves of swivel 10
- the drillstring will then tend to rotate back toward its starting position, under the influence of the trapped torque, thereby tending to rotate second member 50 with respect to the first member 40. This imparts a force on load cell 90, and the amount of the torque can be monitored and measured at all times, through the control panel/load cell.
- the entirety of the drillstring, swivel with attached apparatus, side entry sub, etc. can be raised and lowered by means of the rig traveling block, in order to work the torque downhole to the desired connection. It can be appreciated from the foregoing description that the drillstring can be raised and lowered with little restriction on height, and that the safety issues associated with hold-back cables and conventional tongs are eliminated. The present invention permits constant monitoring of the torque in the drillstring, while safely permitting raising and lowering of the drillstring as needed.
- when the appropriate torque has been worked downhole to the desired connection, a stringshot can be fired via wireline to cause the connection to unscrew. This will be reflected by a reduction or elimination of the torque being held at the surface by the apparatus, which is being monitored by the apparatus, so that it is possible to know in real time whether the backoff effort was successful; if not, the process can be repeated.

Materials for Fabrication of the Apparatus

As well known to those in the relevant field, various parts of the apparatus may be advantageously fabricated from metals, including high strength steel and steel alloys. Where suitable, other materials may be used for certain parts of the apparatus.

Conclusion

While the preceding description contains many specificities, it is to be understood that same are presented only to describe some of the presently preferred embodiments of the invention, and not by way of limitation. Changes can be made to various aspects of the invention, without departing from the scope thereof. For example:

- either or both of the first and second members may comprise a releasable, gripping apparatus, to grip the exterior of the swivel.
- size of the apparatus may be varied to suit particular applications.
- different means for connecting first and second members may be used; in the preferred embodiment, a pair of downwardly extending plates are attached to first member, but similar plates could also be attached to the second member, or to the second member exclusively; alternatively, some form of flexible member could connect the first and second members, with the means for measuring force between first and second members imposed therebetween. The scope of the present invention encompasses any structure and manner in which first and second members may be connected, so as to enable measurement of forces therebetween.
- Various types and forms of processing and controlling the different parts of the apparatus may be provided.

Therefore, the scope of the invention is to be determined not by the illustrative examples set forth above, but by the appended claims and their legal equivalents.

I claim:

1. An apparatus for rotationally locking a drillstring swivel having two halves, while permitting monitoring of torque between the halves of the swivel, comprising:

a first member attached to the exterior of one half of the swivel;

a second member releasably attached to the exterior of the other half of the swivel;

a means for structurally connecting first and second members; and means for measuring force imposed between said first and second members, and for determining torque between said first and second members.

2. The apparatus of claim 1, wherein:

said first member comprises a collar encircling said swivel, a means for connecting said collar to said swivel, and a main plate extending outwardly from said swivel;

said second member comprises a releasable gripping means; and said apparatus further comprises a means for controlling said releasable gripping means.

3. The apparatus of claim 2, wherein:

said means for connecting said first and second members comprises a pair of spaced apart, downwardly extending stop plates connected to said first member, forming an opening therebetween, wherein a portion of said second member is disposed within said opening between said pair of stop plates.

4. The apparatus of claim 3, wherein said means for monitoring force imposed between said first and second members, and for determining torque between said first and second members, comprises a load cell disposed between said pair of stop plates and said second member.

5. An apparatus for rotationally locking a drillstring swivel having a non-rotating half and a rotating half, while permitting monitoring of torque between the two halves of the drillstring swivel, comprising:

a first member comprising a cylindrical collar adapted to fit around a non-rotating half of a drillstring swivel, a means for attaching said collar to said swivel, and a main plate attached to said collar and extending outwardly away from a central axis of said collar;

a second member comprising a set of jaws which releasably grip the rotating half of said drillstring swivel, said second member suspended from said first member;

stop plates which substantially lock said first and second members rotationally together;

a means for measuring force between said first and second members arising from torque on said drillstring swivel;

a means for determining torque between said halves of said drillstring swivel.

6. The apparatus of claim 5, wherein:

said stop plates comprise a pair of spaced apart plates extending from said main plate, forming an opening therebetween, into which a portion of said second member is disposed.

7. The apparatus of claim 6, wherein said means for monitoring torque between said non-rotating half and said rotating half of said drilling swivel comprises a load cell and microprocessor.

8. The apparatus of claim 5, further comprising a control panel for selectively controlling said jaws of said second member, to enable gripping and releasing a rotating half of said swivel.

9. The apparatus of claim 8, wherein said second member comprises hydraulic cylinders which move said jaws.

10. The apparatus of claim 5, wherein said means for attaching said collar to said swivel comprises a plurality of threaded fasteners.

* * * * *